US009136593B2

(12) United States Patent
Motta Cruz

(10) Patent No.: US 9,136,593 B2
(45) Date of Patent: Sep. 15, 2015

(54) COMPACT HIGH-GAIN ANTENNA

(75) Inventor: Eduardo Motta Cruz, Saint Herblain (FR)

(73) Assignee: BOUYGUES TELECOM, Paris (FR)

( * ) Notice: Subject to any disclaimer, the term of this patent is extended or adjusted under 35 U.S.C. 154(b) by 230 days.

(21) Appl. No.: 13/824,230

(22) PCT Filed: Sep. 29, 2011

(86) PCT No.: PCT/EP2011/067026

§ 371 (c)(1),
(2), (4) Date: Mar. 15, 2013

(87) PCT Pub. No.: WO2012/041979

PCT Pub. Date: Apr. 5, 2012

(65) Prior Publication Data

US 2013/0176188 A1 Jul. 11, 2013

(30) Foreign Application Priority Data

Sep. 29, 2010 (FR) ..... 10 57864

(51) Int. Cl.

| | |
|---|---|
| ***H01Q 21/00*** | (2006.01) |
| ***H01Q 1/38*** | (2006.01) |
| ***H01Q 1/24*** | (2006.01) |
| ***H01Q 21/06*** | (2006.01) |
| ***H01Q 21/08*** | (2006.01) |

(52) U.S. Cl.

CPC ..... *H01Q 1/38* (2013.01); *H01Q 1/246* (2013.01); *H01Q 21/0006* (2013.01); *H01Q 21/065* (2013.01); *H01Q 21/08* (2013.01)

(58) Field of Classification Search

CPC ..... H01Q 1/246; H01Q 1/38; H01Q 21/0006; H01Q 21/065; H01Q 21/08

USPC ..... 343/844, 700 MS

See application file for complete search history.

(56) References Cited

U.S. PATENT DOCUMENTS

| | | | | |
|---|---|---|---|---|
| 6,999,030 | B1 * | 2/2006 | Mateychuk | 343/700 MS |
| 7,591,792 | B2 * | 9/2009 | Bouton | 600/587 |
| 7,626,547 | B2 * | 12/2009 | Schillmeier et al. | 343/700 MS |
| 2002/0084945 | A1 * | 7/2002 | Huebner | 343/853 |

FOREIGN PATENT DOCUMENTS

| | | |
|---|---|---|
| FR | 2945380 | 11/2010 |
| WO | WO 98/27614 | 6/1998 |
| WO | WO 99/17403 | 4/1999 |
| WO | WO 01/06595 | 1/2001 |
| WO | WO 03/009752 | 2/2003 |
| WO | WO 2007/126831 | 11/2007 |

* cited by examiner

*Primary Examiner* — Hoang V Nguyen

(74) *Attorney, Agent, or Firm* — Blakely Sokoloff Taylor & Zafman LLP

(57) ABSTRACT

The invention relates to a panel antenna comprising: a ground plane (P); a dielectric substrate (11) having a permittivity ($\in_1$), the substrate (11) being located on the ground plane (P); at least one radiating source ($S_i$), each radiating source consisting of a plurality of antenna elements ($E_{ij}$), the antenna elements ($E_{ij}$) being located on the substrate (11) and furthermore consecutively spaced apart, relative to one another, by a distance ($d_e$) shorter than one wavelength λ, the wavelength λ corresponding to the antenna operating frequency. The antenna is characterized in that it furthermore comprises a dielectric superstrate (12) having a permittivity ($\in_2$) higher than the permittivity ($\in_1$) of the substrate (11), the superstrate being located above the antenna elements ($E_{ij}$), and in that the antenna elements ($E_{ij}$) are all identical and have, in operation, identical radiation characteristics.

8 Claims, 5 Drawing Sheets

FIG. 2a
(Prior Art)
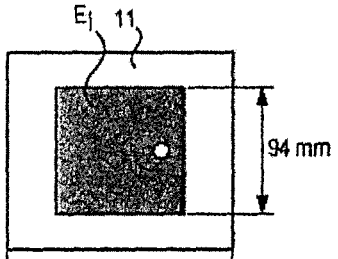
FIG. 2b
(Prior Art)
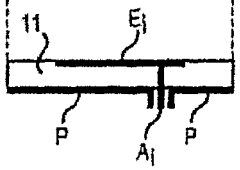
FIG. 3a
(Prior Art)
| Number of radiating elements | Gain (dBi) |
|---|---|
| 1 | ~8 |
| 2 | ~11 |
| 4 | ~14 |
| 5 | ~15 |
| 8 | ~17 |
FIG. 3b
(Prior Art)
Antenna height
| | **Frequency** | |
|---|---|---|
| **Gain** | 900 MHz (λ = 33 mm) | 2100 MHz (λ = 15 mm) |
| 15 dBi | 1.18 m | 0.54 m |
| 17 dBi | 2.4 m | 1.2 m |

COMPACT HIGH-GAIN ANTENNA

GENERAL TECHNICAL FIELD

The invention relates to the field of panel antennas, particularly those used in cellular networks.

STATE OF THE ART

Base transceiver stations (BTS) are subject to major constraints in terms of height arrangement (church louvers, bas-reliefs of the façades of protected buildings, etc.).

Cellular networks currently resort to isotropic high-gain antennas in order to maximise their radio range. These gains are obtained by means of panels of heights commonly varying between 1.2 m for the 1800/2100 MHz band and 2.4 m for the 900 MHz band.

A panel antenna comprises in the familiar manner a plurality of antenna elements arranged in a vertical row on a substrate.

FIG. 1 illustrates a panel antenna of known type.

The panel antenna in FIG. 1 comprises eight antenna elements $E_i$ (i=1 to 8) arranged on a substrate 11; each antenna element $E_i$ comprises an access point $A_i$ and is spaced apart at a distance $d_e$ of approx. 0.9λ, wherein λ is the vacuum wavelength at the central frequency of the frequency band of the antenna. The distance is understood between two access points $A_i$ of the antenna elements $E_i$.

The antenna elements $E_i$ are supplied in a tree structure for example: the adjacent antenna elements $E_i$ are connected two by two by means of a first supply line $L_1$ in order to form four pairs of antenna elements.

The pairs are furthermore connected two by two by means of a second supply line $L_2$ in order to form two quadruplets of antenna elements and the quadruplets are finally interconnected by means of a third supply line $L_3$.

It is observed that the supply lines are defined between two access points $A_i$ of each antenna element $E_i$.

FIGS. 2*a* and 2*b* respectively illustrate a top view and a side view of an antenna element $E_i$ arranged on a substrate 11. The antenna element $E_i$ arranged on the substrate forms a radiating source termed a "patch".

The dielectric substrate 11 has a dielectric constant $\in_1$ and is arranged on a ground plane P, wherein the antenna element $E_i$ is arranged on the substrate 11.

The antenna element $E_i$ is arranged on the dielectric substrate 11 connected to a connector $A_i$ in order to supply the antenna element $E_i$.

Each antenna element $E_i$ displays during operation a unit gain of approx. 8 dBi; the antenna in FIG. 1 therefore displays a gain of 8 dBi+10 log(8)=17 dBi for a height of 8×0.9λ=7.2λ.

The tables in FIGS. 3*a* and 3*b* show the ratio between the gain of the antenna and its height for two main frequency bands used in cellular networks (the 880-960 MHz band, known as "900 MHz" and the 1710-2170 MHz band, known as "2100 MHz") at the central frequency of the antenna frequency band. It is noticed in particular that in order to progress from a gain of 15 dBi to 17 dBi, the antenna height needs to be approximately doubled for a given central frequency.

It can therefore be seen that the height of the antenna is dictated by the number of antenna elements $E_i$. Hence, the greater the gain of the antenna, the more elements are required and the larger the size of the antenna.

This is not unproblematic, since the current trend involves imposing maximum heights for panel antennas or indeed reductions in height.

A solution is known for reducing the size of a panel antenna, involving eliminating some antenna elements $E_i$. Such elimination however results in a loss in terms of antenna gain and therefore deterioration in the antenna performances.

PRESENTATION OF THE INVENTION

One aim of the invention is to enable an increase in the gain of an antenna without having to increase the size of the antenna.

Another aim of the invention is to enable a reduction in the height of an antenna without any decrease in the gain of the antenna.

Hence, the invention relates to a panel antenna comprising a ground plane, a dielectric substrate, having a permittivity, wherein the substrate is arranged on the ground plane, at least one radiating source, wherein each radiating source is formed of a plurality of antenna elements, wherein the antenna elements are arranged on the substrate and are furthermore consecutively spaced apart in relation to one another at a distance of less than a wavelength λ, said wavelength λ corresponding to the antenna operating frequency.

The antenna according to the invention is characterised in that it furthermore comprises a dielectric superstrate, having a permittivity greater than the permittivity of the substrate, wherein the superstrate is arranged above the antenna elements and the antenna elements are all identical and possess during operation identical radiating characteristics.

The arrangement of the antenna elements forming each radiating source makes it possible to achieve a reduction in height with constant gain or obtain an increase in the gain with constant height.

Preferably, the antenna furthermore comprises a dielectric superstrate, having a permittivity greater than the permittivity of the substrate, wherein the superstrate is arranged on the antenna elements.

The combination of the superstrate with the arrangement of the antenna elements makes it possible to achieve either the reduction in height with constant gain or an increase in the gain with constant height.

The invention is advantageously supplemented by the following characteristics, considered alone or in any of their technically feasible combinations:

- each radiating source comprises four antenna elements connected successively in pairs by the means of a first supply line, wherein said pairs are connected to each other by means of a second supply line, wherein the centre of the second supply line comprises an access point of the radiating source adapted for supply of said radiating source;
- it comprises several radiating sources, wherein the radiating sources are arranged in relation to each other such that their access points are spaced apart by a distance equal to the distance between two antenna elements, wherein each radiating source possesses identical radiating characteristics;
- the antenna elements are arranged in relation to one another with a distance $d_e$ equal to $d_s(N-1)/N$, wherein $d_s$ is the distance between two access points of two radiating sources and N is the number of antenna elements of each radiating source;
- each radiating source preferentially comprises between two and six antenna elements;
- the antenna elements are patches having a shape selected from among the following group: square, equilateral triangle, elliptical;

the antenna elements are derived from the following technologies: horns or wire antennas;

it comprises a resistance connected between the ground plane and each antenna element.

The invention also relates to a cellular communication network comprising a panel antenna according to the invention.

BRIEF DESCRIPTION OF THE DRAWINGS

FIGS. 2*a* and 2*b* respectively illustrate a top view and a side view of an antenna element;

FIGS. 3*a* and 3*b* respectively illustrate the ratio between the gain of the antenna and its height for two main frequency bands;

In all the figures, similar elements bear identical numerical references.

DETAILED DESCRIPTION OF THE INVENTION

Two embodiments of the invention are described below in relation to FIGS. 4 to 9.

"Antenna element" is taken to mean a radiating element having a preferably flat conducting body.

"Radiating source" is taken to mean the combination of several antenna elements.

"Panel antenna" is taken to mean a planar antenna comprising several antenna elements.

For each embodiment, the panel antenna comprises a dielectric substrate 11 having a permittivity $\in_1$, wherein the substrate 11 is arranged on a ground plan P. Furthermore, the panel antenna comprises at least one radiating source $S_i$.

Each radiating source $S_i$ is formed of a plurality of antenna elements $E_{ij}$ consecutively spaced apart in relation to one another. Two consecutive antenna elements are spaced apart by a distance $d_e$ less than the wavelength $\lambda$, said wavelength $\lambda$ corresponding to the antenna operating frequency.

Figure 1:
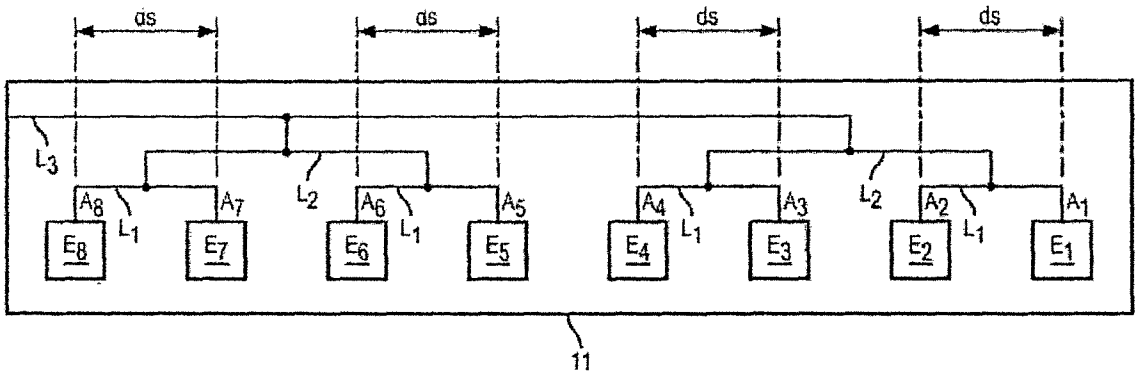
FIG. 1 (Prior Art)
FIG. 1 illustrates apanel antenna of known type.
Figure 4:
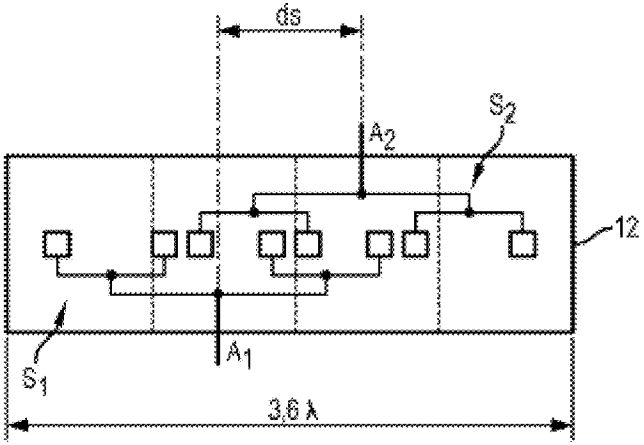
FIG. 4 illustrates a panel antenna according to a first embodiment of the invention.
Figure 5:
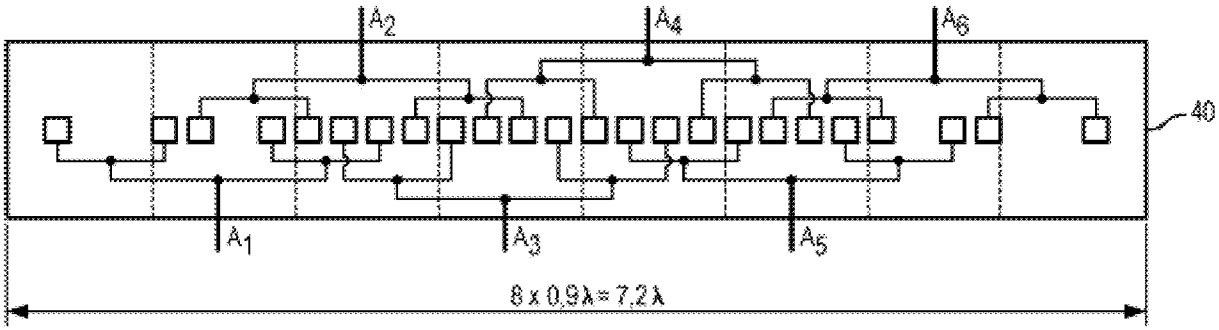
FIG. 5 illustrates a panel antenna according to a second embodiment of the invention.

The antenna in FIG. 4 comprises two radiating sources $S_1$, $S_2$ and the antenna in FIG. 5 comprises six radiating sources.

Advantageously, each radiating source $S_i$ comprises four antenna elements $E_{i1}$, $E_{i2}$, $E_{i3}$, $E_{i4}$ connected in pairs in a tree structure for example by means of a first supply line $L_1$.

Each antenna element comprises an access point $A_{ij}$ for connection of the antenna elements in pairs by means of the supply line $L_1$.

The pairs of antenna elements $E_{ij}$ are connected by means of a second supply line $L_2$. The centre of the second supply line $L_2$ comprises an access point $A_i$ of the radiating source $S_i$. Such an access point $A_i$ is adapted for supply of the radiating source $S_i$ to which it refers.

As can be seen, there are as many access points $A_i$ as there are radiating sources $S_i$. Hence, the antenna in FIG. 5 comprising six radiating sources therefore comprises six access points $A_1$, $A_2$, $A_3$, $A_4$, $A_5$, $A_6$.

The radiating sources $S_i$ are arranged in relation to each other such that their access points $A_i$ are spaced apart by a distance equal to the distance $d_s$ between two consecutive access points of two radiating sources $S_i$.

Furthermore, the antenna elements $E_{ij}$ of a radiating source $S_i$ are arranged in relation to one another with a distance $d_e$ equal to $d_s(N-1)/N$, wherein $d_s$ is the distance between the radiating sources $S_i$ and N is the number of antenna elements $E_{ij}$ of each radiating source $S_i$. The distance $d_e$ is in turn the distance between two consecutive access points $A_{ij}$ of each antenna element $E_{ij}$.

To be more precise, in defining a main axis passing through the centres of symmetry of each antenna element, the access points $A_{ij}$ of each antenna element are located on an axis perpendicular to the main axis, the first and second supply lines $L_1$, $L_2$ being parallel to the main axis.

Preferably, each radiating source $S_i$ comprises four radiating elements $E_{ij}$.

The antenna furthermore comprises (those of FIGS. 4 and 5) a dielectric superstrate 12 having a permittivity $\in_2$ greater than the permittivity $\in_1$ of the substrate 11 which is arranged on the antenna elements $E_{ij}$.

In relation to an antenna element $E_i$ forming a radiating source of the patch type, of known type, the antenna element $E_{ij}$ is thus immersed in a medium with high permittivity, which allows a reduction in the size of the antenna element in order to reduce its operating wavelength, or rather retain it and reduce its physical dimensions.

Use of the substrate 12 makes it possible to retain radiating characteristics identical to those of an antenna element of greater height.

Figure 6A:
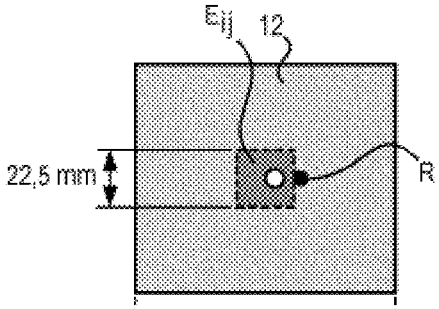
FIGS. 6*a* and 6*b* respectively illustrate a top view and a side view of an antenna element of the antenna according to the invention.
Figure 6B:
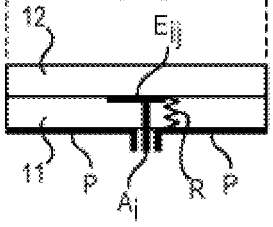

Furthermore, a resistance R is connected between the ground plane P and each antenna element $E_{ij}$ (refer to FIGS. 6*a* and 6*b*). The resistance R is typically equal to one Ohm. This resistance R serves to short circuit one of the radiating sides of the antenna element. This short circuit serves to transform the radiating element of size $\lambda/2$, formed of two monopoles, each of size $\lambda/4$ on each side of the dipole, into a single monopole of size $\lambda/4$ and consequently makes it possible to halve the electrical dimensions of the radiating element.

This resistance R also allows an appreciable increase in the passband of the antenna in its resonant behaviour.

Finally, the permittivity $\in_1$ is for example between 1 and 4 and is preferably equal to 2.2 and the permittivity $\in_2$ is for example between 10 and 50 and is preferably equal to 30.

By way of example, in relation to the antenna element $E_i$ of a patch of known type, for an operating frequency in the GSM band at a central frequency of 920 MHz, the side of the antenna element $E_i$ is of dimensions equal to 94 mm whereas the side of the antenna element $E_{ij}$ (with the superstrate) is of dimensions equal to 21.5 mm.

Still by way of example, one may consider antenna elements $E_{ij}$ which are square, in the shape of an equilateral triangle or elliptical in shape or derived from the following technologies: horns or wire antennas allowing combination of sources owing to their small size or small radiating aperture.

Reduction in Height—Constant Gain

The antenna illustrated in FIG. 4 allows a reduction in height of a panel antenna of known type while retaining the same gain of 17 dBi.

Figure 7:
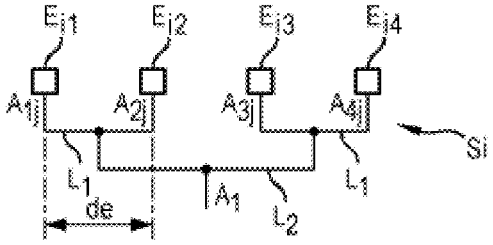
FIG. 7 illustrates and elemental source according to the invention.

It comprises two radiating sources $S_1$, $S_2$ spaced apart by a distance $d_s$=0.9λ, each consisting of four antenna elements spaced apart by a distance $d_e$=0.9λ (4−1)/4=0.675λ (refer to FIG. 7).

Each radiating source displays a gain of 14 dBi during operation such that the antenna in FIG. 4 displays a gain of 17 dBi during operation.

Figure 8:
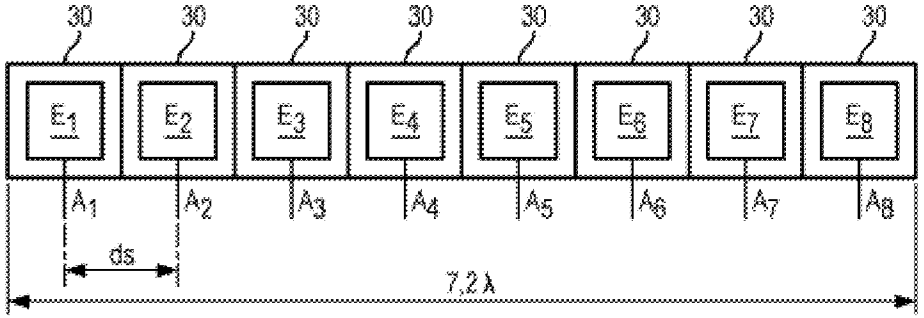
FIG. 8 illustrates a panel antenna of known type displaying during operation the same gain as the antenna according to the first embodiment of the invention.

Nevertheless, in relation to the antenna as illustrated in FIG. 8, the height is halved: the reduction is from 7.2λ (8×0.9λ) to 3.6λ (4×0.9λ).

The radiating sources $S_1$ and $S_2$, each having an access point $A_1$, $A_2$, are nested along the longitudinal axis of the antenna (refer to FIG. 4) such that the points of access $A_i$ of the sources $S_i$ are set apart by the same distance $d_s$. In order to facilitate understanding of the supply circuit of the different sources, each access point is arranged on a side opposite the following access point.

The distance between two consecutive radiating elements belonging to two different radiating sources varies between $d_s$/N and $d_s$(N−1)/N, i.e. between 0.225λ and 0.675λ.

Increase in Gain—Constant Height

The antenna illustrated in FIG. 5 allows an increase in gain of the antenna while retaining the same height as a panel antenna of known type.

It comprises six radiating sources, each consisting of four antenna elements (refer to FIG. 7).

Figure 9:
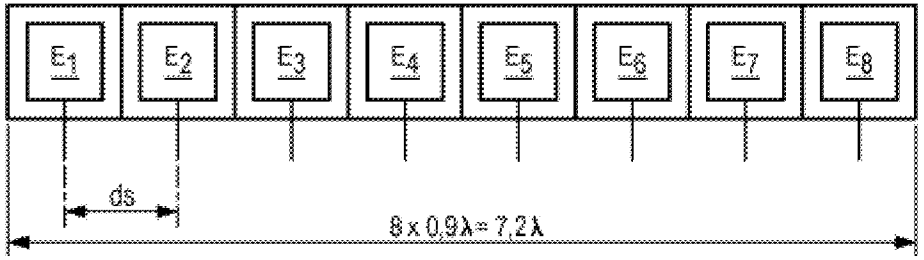
FIG. 9 illustrates a panel antenna of known type having the same height as the antenna according to the second embodiment of the invention.

As in the preceding embodiment, each radiating source displays a gain of 14 dBi during operation such that the antenna in FIG. 5 displays a gain of 21.8 dBi during operation instead of 17 dBi obtained by the antenna of the same height, as illustrated in FIG. 9 (height equal to 7.2λ).

As above, the radiating sources, each having an access point $A_1$, $A_2$, $A_3$, $A_4$, $A_5$, $A_6$, are nested along the longitudinal axis of the antenna (refer to FIG. 5) such that the access points $A_i$ of the sources $S_i$ are set apart by the same distance $d_s$. In order to facilitate understanding of the supply circuit of the different sources, each access point is arranged on a side opposite the following access point.

The distance between two consecutive radiating elements belonging to two different radiating sources varies between $d_s$/N and $d_s$(N−1)/N, i.e. between 0.225λ and 0.675λ.

The invention claimed is:

1. Panel antenna comprising a ground plane (P), a dielectric substrate (11), having a permittivity ($e_1$), wherein the substrate (11) is arranged on the ground plane (P), at least one radiating source ($S_i$) formed of at least one pair of antenna elements ($E_{ij}$) arranged on the substrate (11), the antenna elements being all identical and have during operation identical radiating features and are furthermore consecutively spaced apart in relation to one another at a distance ($d_e$) of less than a wavelength λ, said wavelength λ corresponding to the antenna operating frequency, the antenna elements being connected successively in pairs by a first supply line ($L_1$), wherein said pairs are connected to each other by a second supply line ($L_2$), the centre of the second supply line ($L_2$) comprising an access point ($A_i$) of the radiating source ($S_i$) adapted for supplying said radiating, source ($S_i$);

a dielectric superstrate (12), having a permittivity ($\in_2$) greater than the permittivity ($e_1$) of the substrate (11), wherein the superstrate is arranged above the antenna elements ($E_{ij}$) and the antenna elements ($E_{ij}$);

a resistance (R) connected between the ground plane (P) and each antenna element ($E_{ij}$).

2. Antenna according to claims 1 wherein each radiating source ($S_1$) comprises four antenna elements ($E_{i1}$, $E_{i2}$, $E_{i3}$, $E_{i4}$).

3. Antenna according to claim 2, comprising several radiating sources ($S_i$), wherein the radiating sources ($S_i$) are arranged in relation to each other such that their access points ($A_i$) are spaced apart by a distance equal to the distance between two antenna elements ($E_{ij}$), wherein each radiating source ($S_i$) possesses identical radiating characteristics.

4. Antenna according to claim 1, wherein the antenna elements ($E_{ij}$) are arranged in relation to one another with a distance $d_e$ equal to $d_s$(N−1)/N, wherein $d_s$ is the distance between two access points ($A_i$) of two radiating sources ($S_i$) and N is the number of antenna elements ($E_{ij}$) of each radiating source ($S_i$).

5. Antenna according to claim 1, wherein each radiating source ($S_i$) preferentially comprises between two and six antenna elements ($E_{ij}$).

6. Antenna according to claim 1, wherein the antenna elements ($E_{ij}$) are patches having a shape selected from among the following group: square, equilateral triangle, elliptical.

7. Antenna according to claim 1, wherein the antenna elements ($E_{ij}$) are derived from the following technologies: horns or wire antennas.

8. Cellular communication network comprising a panel antenna according to claim 1.

* * * * *

UNITED STATES PATENT AND TRADEMARK OFFICE

CERTIFICATE OF CORRECTION

PATENT NO. : 9,136,593 B2
APPLICATION NO. : 13/824230
DATED : September 15, 2015
INVENTOR(S) : Eduardo Motta Cruz It is certified that error appears in the above-identified patent and that said Letters Patent is hereby corrected as shown below:

Column 6, Claim 2, line 14, please delete "($\in_2$)" and insert --($\square_2$)--.

Signed and Sealed this
Twenty-second Day of March, 2016

Michelle K. Lee

Michelle K. Lee
*Director of the United States Patent and Trademark Office*